US006712550B2

(12) United States Patent
Fervers

(10) Patent No.: US 6,712,550 B2
(45) Date of Patent: Mar. 30, 2004

(54) ROLLER DEVICE FOR COMPACTING THE GROUND COMPRISING SLIP CONTROL

(75) Inventor: Wolfgang Fervers, Munich (DE)

(73) Assignee: Wacker Construction Equipment AG, Munich (DE)

( * ) Notice: Subject to any disclaimer, the term of this patent is extended or adjusted under 35 U.S.C. 154(b) by 0 days.

(21) Appl. No.: 10/182,021

(22) PCT Filed: Apr. 6, 2001

(86) PCT No.: PCT/EP01/03989

§ 371 (c)(1),
(2), (4) Date: Jul. 19, 2002

(87) PCT Pub. No.: WO01/92640

PCT Pub. Date: Dec. 6, 2001

(65) Prior Publication Data

US 2002/0192027 A1 Dec. 19, 2002

(30) Foreign Application Priority Data

May 30, 2000 (DE) ..... 100 26 703

(51) Int. Cl.[7] ..... E01C 19/28; E02D 3/026
(52) U.S. Cl. ..... 404/122; 404/127
(58) Field of Search ..... 404/122, 124, 404/125, 126, 127, 128, 132, 133.05, 133.1, 133.2, 117

(56) References Cited

U.S. PATENT DOCUMENTS

| | | | | |
|---|---|---|---|---|
| 5,177,415 A | * | 1/1993 | Quibel et al. | 318/128 |
| 5,248,216 A | | 9/1993 | Vural | |
| 5,507,593 A | * | 4/1996 | Hollon et al. | 404/122 |
| 5,915,492 A | | 6/1999 | Yates et al. | |
| 2003/0047003 A1 | * | 3/2003 | Miyamoto et al. | 404/117 |
| 2003/0048082 A1 | * | 3/2003 | Gandrud | 318/128 |

FOREIGN PATENT DOCUMENTS

DE 297 23 171 4/1998

* cited by examiner

*Primary Examiner*—Thomas B. Will
*Assistant Examiner*—Alexandra K. Pechhold
(74) *Attorney, Agent, or Firm*—Boyle Fredrickson Newholm Stein & Gratz S.C.

(57) ABSTRACT

A roller device for compacting the ground comprising a rotatably driven first roller facing, whose speed can be modified, at least within a certain range. Device includes a unit for determining the vertical distance between a surface of a compacted ground lying behind the first roller facing and a lowest point of the first roller facing, and by a speed regulating device for modifying the speed of the first roller facing, based on said distance. The speed regulation device allows the speed of the roller facing to be adjusted in such a away that slip is prevented without determining the actual slip between the roller facing and the ground.

20 Claims, 1 Drawing Sheet

ROLLER DEVICE FOR COMPACTING THE GROUND COMPRISING SLIP CONTROL

BACKGROUND OF THE INVENTION

1. Field of the Invention

The invention relates to a roller apparatus for soil compaction in accordance with the preamble of patent claim 1.

2. Description of the Related Art

For the compaction of soils, road surfaces or the like, compaction rollers are known which compact the ground as they travel over it by means of the load of one or more cylindrical "roller tires" and in some cases also by means of additional vibration. Depending on the type and design of the compaction roller, the individual roller tires can each be embodied as a non-driven, freely rolling towed roller tire or as a driven roller tire contributing to the propulsion of the compaction roller.

In addition to the type and composition of the ground to be compacted and the operational state of the compaction roller, the slip of the roller tires, in particular, has a pronounced influence on the degree of compaction and the quality of the compacted surface. The term "slip" is borrowed from automotive engineering and corresponds to a difference in speed between a shell or rolling surface of the roller tire and the soil.

Insufficient, generally negative slip therefore means that the peripheral speed of the roller tire is lower than the horizontal speed at which the roller tire moves over the soil. It arises especially in the case of non-driven, towed roller tires, as these, because of their inertia and rolling resistance, rotate more slowly than would be necessary for rolling on top of the soil. As a consequence of negative slip, accumulations of material may be formed in front of the roller ("bulldozing effect") and, depending on the operating conditions, may be rolled over at irregular intervals, which results in an uneven, undulating surface. On the other hand, with negative slip, transverse cracks may be formed in the surface behind the roller tire as a result of tractive stresses in the soil, these also being known as "roller cracks"; although they can be closed at the surface by subsequent rolling, they can hardly ever be eliminated.

An excessive, usually positive slip, such as frequently occurs with driven roller tires, can in some cases result in scuffing or gouging behind the roller tire. On the other hand, excessive slip may also, depending on the composition of the ground, give rise to the risk of reloosening of the compacted soil behind the roller tire.

The optimum slip for soil compaction depends both on the operating state of the compaction roller and on the type and composition of the ground. In practice, it is impossible to predetermine a clear, constant value for optimum slip under different operating conditions on different soils.

Further problems are caused by slip behavior in the case of roller apparatuses having a plurality of driven roller tires, as in such cases it must always be expected that at least one of the tires will have excessive or inadequate slip.

OBJECTS AND SUMMARY OF THE INVENTION

It is an object of the invention to provide a roller apparatus for soil compaction in which, irrespective of the operating state of the apparatus or of the state of the soil, optimum slip is always set automatically.

The solution to this problem is as defined in claim 1. Advantageous further developments of the invention will be found in the dependent claims.

The roller apparatus according to the invention comprises a determining device, by means of which it is possible to determine a vertical distance between a surface of the compacted soil lying behind the first roller tire, in other words a surface that has just been rolled, and a lowest point of the first roller tire, in other words the lower apex of the cylindrical roller tire. A speed of rotation adjustment device is able to set, as a function of the distance, the speed of rotation of the roller tire to be adjusted.

With the proviso that the distance is defined as positive when the surface of the compacted soil lies at a higher vertical level than the lowest point of the roller tire, in other words that the roller tire is producing a build-up of soil behind it, which corresponds to positive slip, the speed of rotation adjustment device reduces the speed of rotation when the distance is above a predetermined upper limiting value. Correspondingly, when the distance is negative, in other words the surface of the compacted soil lies at a lower vertical level than the lowest point of the roller tire, which corresponds to negative slip, the speed of rotation adjustment device can increase the speed of rotation when the distance is below a predetermined lower limiting value.

In a particularly advantageous embodiment of the invention, the upper and lower limiting values are identical and correspond to a slightly positive value which is just in excess of zero. This makes it possible to take account of the fact that the compacted soil, because of its elasticity, springs back after being rolled over by the roller tire, so that even when no slip takes place the distance must take on an—albeit low—positive value, as the sprung-back surface of the compacted soil lies at a higher vertical level than the lower apex of the roller tire.

In a further advantageous embodiment of the invention, a distance measurement device is provided whereby the length of a vertical distance between the surface of the soil and a reference point on the roller apparatus can be measured. The determining device is then able to calculate the vertical distance as the difference between a lengthwise value, predetermined by the mechanical structure of the roller apparatus, and already stored in the determining device, for a vertical distance between the reference point and the lowest point, in other words the lower apex, of the roller tire and the vertical distance measured by the distance measurement device.

The slip control system according to the invention can be used particularly advantageously with a roller apparatus in which, apart from the controlled roller tire, at least one further roller tire driven in rotation is present. The additional roller tire then serves, inter alia, to support the force or torque for the first, controlled roller tire.

Advantageously, the controlled roller tire, viewed in the direction of travel of the roller apparatus, is the rearmost of all the driven roller tires.

BRIEF DESCRIPTION OF THE DRAWINGS

These and other advantages and features of the invention are explained below with reference to an example of embodiment and with the aid of the figures, in which.

DETAILED DESCRIPTION OF THE PREFERRED EMBODIMENTS

Figure 1:
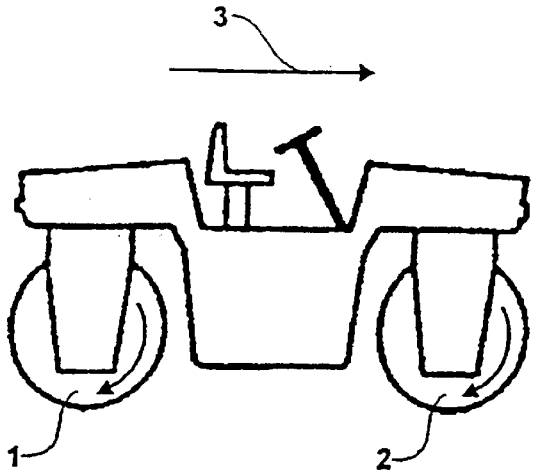
FIG. 1 shows a roller apparatus according to the invention in a diagrammatic lateral view.

FIG. 1 shows a compaction roller serving as a roller apparatus for soil compaction and comprising a first roller tire 1 driven in rotation and a second roller tire 2 likewise driven in rotation.

Since such a roller apparatus is known in principle, both with and without a vibratory drive acting on the roller tires, a more detailed description would be superfluous.

The roller tires 1, 2 are driven in a manner known per se with the aid of a mechanical, hydraulic or electrical system or a combination of such systems, which allow the speed of rotation of the drive to be varied by very narrow intervals or continuously.

A direction of travel of the roller apparatus is indicated by an arrow 3.

Figure 2:
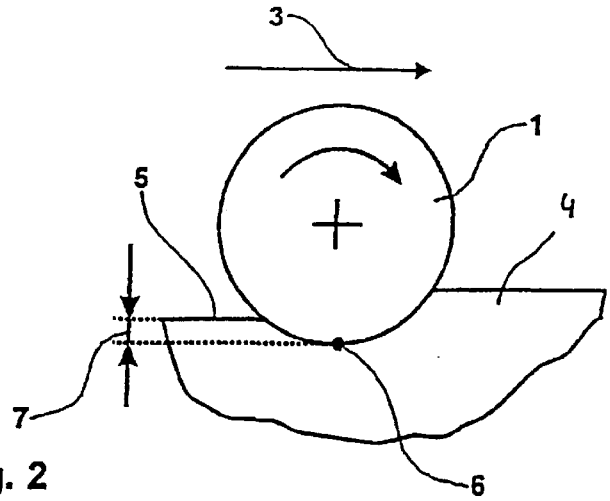
FIG. 2 shows the state of positive slip in a diagrammatic view.

FIG. 2 shows, in a diagrammatic view on a larger scale, the first roller tire 1 rolling over the soil 4 to be compacted. It is apparent that a surface 5 of the previously compacted soil behind the roller tire 1 lies at a higher vertical level than a lowest point 6 of the roller tire 1. The lowest point 6 here is regarded as being the lower apex or a point on the further vertical diameter of the roller tire 1.

In view of the configuration shown in FIG. 2, it is apparent that the roller tire 1 is digging into the soil 4 as a result of excessive slip. A vertical distance 7 between the soil surface 5 and the lowest point 6 here has, by definition, a positive value.

The roller apparatus comprises a determining device (not shown in the figures) which determines the distance 7 and supplies it to a speed of rotation adjustment device (likewise not shown in the figures). The speed of rotation adjustment device is able to vary the speed of rotation of the roller tire 1 as a function of the distance 7.

In view of the finding that the distance 7 is positive in the state shown in FIG. 2 and the slip is thus also positive, the speed of rotation adjustment device endeavors to reduce the slip by reducing the speed of rotation. Such a case can arise, for example, if the front roller tire 2 of the roller apparatus is rotating too slowly, so that the rearward roller tire 1 can only achieve an inadequate horizontal speed over the soil 4.

Figure 3:
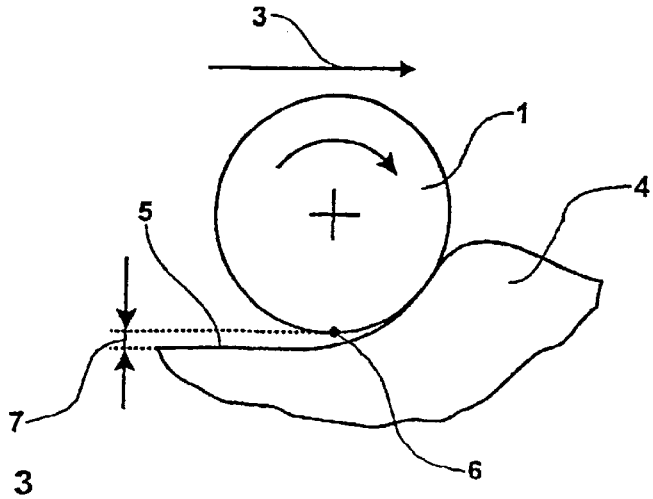
FIG. 3 shows the state of negative slip in a diagrammatic view.

FIG. 3 shows the roller tire 1 in the state of negative slip, in which a build-up of soil 4 has already occurred in front of the roller tire 1. The risk here is that, a short time later, the bulge still present in front of the roller tire 1 will be rolled over, which results in an undulating surface.

In FIG. 3, it is apparent that the surface 5 of the previously compacted soil 4 behind the roller tire 1 lies at a lower vertical level than the lowest point 6 of the roller tire 1. In accordance with the definition given above, therefore, the distance 7 between the surface 5 and the lowest point 6 is negative, which corresponds to negative slip.

The determining device supplies the negative value of the distance 7 to the speed of rotation adjustment device, which, when this value falls below a lower limiting value, endeavors to increase the slip by increasing the speed of rotation of the roller tire 1.

Even if it were to be assumed, from the standpoint of theory, that a zero value for the distance 7 should correspond to the ideal, slip-free state, is has been found in practice that a slightly positive value just above zero is better suited to the avoidance of harmful slip. The reason for this lies in the elastic property of the soil 4, which moves back resiliently after being rolled over by the roller tire 1, so that in the case of slip-free rolling a positive value for the distance 7 must always arise.

To determine the distance 7, it is particularly advantageous to attach a contact-free measuring system, for example a radar distance sensor or a laser, to the running gear of the roller apparatus, which determines the vertical distance between the measuring system serving as a reference point and the surface 5 of the compacted soil 4. Alternatively, a mechanical measuring system is also conceivable, for example with a roller rolling on the surface whose vertical position relative to the running gear of the roller apparatus can be varied and sensed. As the other vertical distance from the stationary measuring system to the lowest point 6 of the roller tire is predetermined for structural reasons by the construction of the roller apparatus 1, the distance 7 can be simply calculated as the difference between the measured vertical distance and the predetermined vertical distance.

The actual construction of the determining device and of the speed of rotation adjustment device can be accomplished with conventional components. A detailed description can therefore be omitted here.

By means of the slip control system according to the invention, it is possible, without the complex determination of the actual slip, as is the case, for example, with ABS and traction control systems on motor vehicles, and irrespective of the type or composition of the ground to be compacted, to set an operating state of the compaction roller which, as a result of minimization of the slip, allows optimum compaction of the ground combined with high quality of the rolled surface.

The invention has been described with reference to the example of a roller apparatus in which only one of the roller tires had been provided with the corresponding slip control system. It is of course also possible, especially with larger roller trains or with roller apparatuses that can be driven either forward or backward, for at least two—for example, the foremost and rearmost—roller tires to be provided whose speed of rotation can be varied by the speed of rotation adjustment device in order to avoid slip. In such cases, then, it would be necessary for the distance 7 between the soil surface and the lowest point of the associated roller tire to be ascertained in each case, by analogy with the method described above.

A system for controlling the direction of travel of the roller apparatus could initially ensure that even in the event of changes in the direction of travel only the rearmost roller tire in each case is subjected to slip control in the manner described.

Finally, it may even be expedient in certain cases, where there are a plurality of roller tires, to equip all of them with a corresponding slip control system and, if necessary, to link the individual speed of rotation adjustment devices to one another in order to effect a coordinated behavior of the individual roller tires.

What is claimed is:

1. A roller apparatus for soil compaction comprising:

a first roller tire driven in rotation, whose speed of rotation is variable at least within a certain range;

a determining device for determining a vertical distance between a surface of the compacted soil lying in the direction of travel behind the first roller tire and a lowest point of the first roller tire, and a speed of rotation adjustment device for varying the speed of rotation of the first roller tire as a function of the distance.

2. The roller apparatus as claimed in claim 1, wherein the distance is defined as positive if the surface of the compacted soil lies at a higher vertical level than the lowest point of the first roller tire and wherein in the converse case the distance is defined as negative.

3. The roller apparatus as claimed in claim 1, further comprising at least one additional driven roller tire.

4. The roller apparatus as claimed in claim 3, wherein the first roller tire is the rearmost of all the driven roller tires viewed in a direction of travel of the roller apparatus.

5. The roller apparatus as claimed in claim 1, wherein the distance measurement device measures a vertical distance between the surface of the soil lying behind the roller tire and a predetermined reference point on the roller apparatus, and wherein the determination device calculates the vertical distance as the difference between 1) a vertical distance, predetermined by the structure of the roller apparatus, between the reference point and the lowest point of the roller tire and 2) the vertical distance measured by the distance measurement device.

6. The roller apparatus as claimed in claim 5, wherein the distance measurement device comprises a contact-free measurement system.

7. A roller apparatus for soil compaction comprising:

a first roller tire driven in rotation, whose speed of rotation is variable at least within a certain range;

a determining device for determining a vertical distance between a surface of the compacted soil lying in the direction of travel behind the first roller tire and a lowest point of the first roller tire, and a speed of rotation adjustment device for varying the speed of rotation of the first roller tire as a function of the distance, wherein the distance is defined as positive if the surface of the compacted soil lies at a higher vertical level than the lowest point of the first roller tire, wherein in the converse case the distance is defined as negative, and wherein the speed of rotation adjustment device reduces the speed of rotation of the first roller tire when the distance is above a predetermined upper limiting value and increases the speed of rotation when the distance is below a predetermined lower limiting value.

8. The roller apparatus as claimed in claim 7, wherein the upper and lower limiting values are identical and/or correspond to a positive value.

9. A roller apparatus for soil compaction comprising:

a first roller tire driven in rotation, whose speed of rotation is variable at least within a certain range;

a determining device for determining a vertical distance between a surface of the compacted soil lying in the direction of travel behind the first roller tire and a lowest point of the first roller tire, and a speed of rotation adjustment device for varying the speed of rotation of the first roller tire as a function of the distance, wherein a distance measurement device is provided for measuring a vertical distance between the surface of the soil lying behind the first roller tire and a predetermined reference point on the roller apparatus, and wherein the determination device calculates the vertical distance as the difference between a vertical distance, predetermined by the structure of the roller apparatus, between the reference point and the lowest point of the first roller tire and the vertical distance measured by the distance measurement device.

10. The roller apparatus as claimed in claim 9, wherein the distance measurement device comprises a contact-free measurement system.

11. A roller apparatus for soil compaction comprising:

a first roller tire driven in rotation, whose speed of rotation is variable at least within a certain range;

a determining device for determining a vertical distance between a surface of the compacted soil lying in the direction of travel behind the first roller tire and a lowest point of the first roller tire, and a speed of rotation adjustment device for varying the speed of rotation of the first roller tire as a function of the distance, wherein at least one further roller tire, driven in rotation, is provided, wherein the roller apparatus is movable forward and backward;

at least two roller tires are provided whose speed of rotation is variable;

the rearmost in each case viewed in the respective direction of travel of the two roller tires is assigned a determining device for determining the vertical distance between the surface of the compacted soil lying behind that roller tire and the lowest point of that roller tire, and wherein the speed of rotation adjustment device for varying the speed of rotation of the two roller tires is formed as a function of the distance determined in each case.

12. The roller apparatus as claimed in claim 11, wherein the speed of rotation adjustment device varies, in each case, the speed of rotation of the rearward of the two roller tires as a function of the distance.

13. A roller apparatus for soil compaction comprising:

a driven roller tire having a variable speed of rotation;

a determining device that determines a vertical distance between a surface of compacted soil Lying in the direction of travel behind the roller tire and a lowest point of the roller tire, and a speed of rotation adjustment device that varies the speed of rotation of the roller tire as a function of the determined distance.

14. The roller apparatus as claimed in claim 13, wherein the determined distance is defined as being positive if the surface of the compacted soil is determined to lie at a higher vertical level than the lowest point of the roller tire and as being negative if the surface of the compacted soil is determined to lie at a lower vertical level than the lowest point of the roller tire.

15. The roller apparatus as claimed in claim 14, wherein the speed of rotation adjustment device reduces the speed of rotation of the roller tire when the determined distance is above a predetermined upper limiting value and increases the speed of rotation when the determined distance is below a predetermined lower limiting value.

16. The roller apparatus as claimed in claim 15, wherein the upper and lower limiting values are at least one of 1) identical and 2) correspond to a positive value.

17. The roller apparatus as claimed in claim 13, wherein the roller tire is a first roller tire, and further comprising at least one further driven roller tire.

18. The roller apparatus as claimed in claim 17, wherein the roller tire is the rearmost of all the driven roller tires viewed in a direction of travel of the roller apparatus.

19. The roller apparatus as claimed in claim 18, wherein the roller apparatus is movable forward and backward;

at least two roller tires are provided whose speed of rotation is variable;

the rearmost in each ease viewed in the respective direction of travel of two roller tires is assigned a determining device for determining the vertical distance between the surface of the compacted soil lying behind that roller tire and the lowest point of that roller tire, and wherein the speed of rotation adjustment device that varies the speed of rotation the two roller tires is formed as a function of the distance determined in each case.

20. The roller apparatus as claimed in claim 19, wherein the speed of rotation adjustment device varies, in each case, the speed of rotation of the rearward of the two roller tires as a function of the determined distance.

* * * * *

UNITED STATES PATENT AND TRADEMARK OFFICE

CERTIFICATE OF CORRECTION

PATENT NO. : 6,712,550 B2
DATED : March 30, 2004
INVENTOR(S) : Wolfgang Fervers

It is certified that error appears in the above-identified patent and that said Letters Patent is hereby corrected as shown below:

Column 6,
Line 44, delete “Lying” and substitute therefore -- lying --;

Column 7,
Line 11, delete “ease” and substitute therefore -- case --;

Column 8,
Line 5, between “rotation” and “the” insert -- of --.

Signed and Sealed this

Twenty-seventh Day of July, 2004

JON W. DUDAS
*Acting Director of the United States Patent and Trademark Office*